US006283432B1

(12) United States Patent
Hoose, Jr.

(10) Patent No.: US 6,283,432 B1
(45) Date of Patent: Sep. 4, 2001

(54) BOOK HOLDER WITH OPTIONAL SWIVEL BASE

(76) Inventor: Frank J. Hoose, Jr., 5203 Pimlico Ct., Fairfax, VA (US) 22032

( * ) Notice: Subject to any disclaimer, the term of this patent is extended or adjusted under 35 U.S.C. 154(b) by 0 days.

(21) Appl. No.: 09/577,985

(22) Filed: May 25, 2000

(51) Int. Cl.[7] ..... A47B 19/00; A47B 23/00; A47B 97/04

(52) U.S. Cl. ..... 248/441.1; 248/458; 248/444; 248/451; 248/445

(58) Field of Search ..... 248/441.1, 458, 248/443, 444, 451, 457, 122.1, 346.03, 222.41, 125.7, 289.11, 445

(56) References Cited

U.S. PATENT DOCUMENTS

| | | | | |
|---|---|---|---|---|
| 3,809,352 | * | 5/1974 | Mathias | 248/451 |
| 3,952,989 | * | 4/1976 | Hatcher | 248/453 |
| 4,569,498 | * | 2/1986 | Ermanski | 248/441.1 |
| 4,767,094 | | 8/1988 | Brown . | |
| 4,771,977 | * | 9/1988 | Larson | 248/460 |
| 4,978,096 | * | 12/1990 | Struckmann | 248/451 |
| 5,025,353 | * | 6/1991 | Menaged | 362/98 |
| 5,085,427 | | 2/1992 | Finn . | |
| 5,112,021 | | 5/1992 | Greene . | |
| 5,375,806 | | 12/1994 | Debus et al. . | |
| 5,579,926 | | 12/1996 | Markarian . | |
| 5,580,024 | * | 12/1996 | Briee | 248/444.1 |
| 5,651,525 | | 7/1997 | Yang . | |
| 5,769,369 | * | 6/1998 | Meinel | 248/176.1 |
| 5,829,787 | | 11/1998 | Newhouse . | |

* cited by examiner

*Primary Examiner*—Leslie A. Braun
*Assistant Examiner*—A. Joseph Wujciak
(74) *Attorney, Agent, or Firm*—Siemens Patent Services, LC

(57) ABSTRACT

A book holder in which an open book may be placed and held in the cavity created by the positioning of an angled back piece, end pieces and front tabs joined to a solid bottom piece upon which the lower edge of the book rests with the open pages loosely secured under the inner edges of the front tabs. Said book holder can be hand held for reading or mounted to an optional swivel base by way of a protruding interlock key in the optional swivel base mating with a keyhole slot in the bottom of the book holder for desk top reading.

5 Claims, 2 Drawing Sheets

BOOK HOLDER WITH OPTIONAL SWIVEL BASE

BACKGROUND OF THE INVENTION

1. Field of the Invention

The present invention relates to the publishing industry, especially in its relation to the leisurely reading of books. More particularly, the invention comprises a holder which securely holds a book with the pages securely held open, but easily turnable, by tabs on either side, with an optional swivel base for hands free reading.

2. Description of the Prior Art

Readers frequently find themselves in the position of wanting to read, but in a situation where it is either awkward or tiresome to hold a book in their hands, such as while eating, reclining or performing other tasks with their hands.

Prior art has suggested a number of methods for holding books open, but they are typically in the form of a stationary stand for holding an open book in a single position. These stands do not allow the flexibility of being able to move around as one reads, read while in a supine position or easily change the angle at which the book is presented to the reader. The purpose of the present invention is to make reading easier in any position, whether the intent is to simply be able to maintain ones place on the page or to free ones hands for other activities.

U.S. Pat. No. 4,767,094, issued to Francis Z. Brown on Aug. 30, 1988, discloses a plastic frame which wraps around the back of a book securing the edges of the pages with transparent tabs on each side. This device allows the reader to either hold the book in his hands or place it on a surface such as a horizontal desk or table top or a slanted surface such as a bed tray. While this device offers mobility and the ability to use it in a supine position, its hands free option appears to be limited to reading while looking down on the book lying in a horizontal position. By contrast, the instant invention allows the reader to stand the book on a horizontal surface, either by use of the basic holder or the optional swivel base. Additionally, the holder itself, serves as a means of protecting the book from water or other damage by allowing the reader to grasp the holder rather than the book itself. This would be especially useful in environments such as the beach or the bath.

U.S. Pat. No. 5,375,806, issued to Larry L. Debus, et al. on Dec. 27, 1994, discloses a hand held book holder, surrounded on the bottom and both sides with a lip and a tab on each end for holding the book in position. Spring hinged tabs at the top of the holder hold the right and left pages in an open position. This device is designed solely for being hand held or placed flat on a surface, with no provision for vertical support in a stationary position. By contrast, the instant invention allows the reader to stand the book on a horizontal surface, either by use of the basic holder or the optional swivel base.

U.S. Pat. No. 5,829,787, issued to David G. Newhouse, Jr. on Nov. 3, 1998, discloses a clipboard type stand to which a book my be secured by straps and a lip along the lower edge. A transparent arm attached at the "clip" stretches across the book to hold the pages in an open position. This device can be used as a hand held holder or as a vertical, table top stand by the use of a flip out support in the back. It does have the disadvantages of having to open the transparent arm in order to turn the page and having the distortion of the arm across text for the entire width of the page. By contrast, the instant invention has the advantage of the reader being able to simply turn the page and slip its edge behind the tab to the left.

U.S. Pat. No. 5,651,525, issued to Sikung Yang on Jul. 29, 1997, discloses a folding, adjustable reading stand which can be used in either a stationary position on a desk top, on one's lap, or a prone position by resting the stand on one's stomach and reading through the transparent material of the stand. Pages are held in an open position with posts on the front edge of a supporting plate. The simplicity of the instant invention relative to the complexity of this stand allows for easier handling of the holder as well as economy in production and therefore required sales price.

U.S. Pat. No. 5,580,024, issued to Yves G. Briee on Dec. 3, 1996 discloses a combination portable book carrying device and book stand. This device provides a stationary support for a book in a vertical position with a provision for adjustment in the angle of presentation from the vertical. The book is held in the open position by transparent tabs on each side. It is not, however, designed for the mobility of leisurely reading, as is the instant invention.

U.S. Pat. No. 3,809,352, issued to Donald L. Mathias on May 7, 1974, discloses a fixed position, transparent stand for holding a book in a basically vertical position on a flat surface. This device completely covers the open book, requiring it to be withdrawn to turn the page. By contrast, the instant invention allows for mobility and easy page turning.

U.S. Pat. No. 5,579,926, issued to Jean Markarian on Dec. 3, 1996, discloses a transparent device for hanging a book from a cabinet door handle or some similar hook. This device completely covers the open book, however, requiring the book to be withdrawn from the device to turn the page. By contrast, the instant invention allows for greater mobility for leisurely reading and ease in turning pages.

U.S. Pat. No. 5,085,427, issued to Bruce Finn on Feb. 4, 1992, discloses a transparent plate with a rear projecting flange at the top for hooking over the data display screen of exercise equipment and a forward projecting flange at the bottom edge for support a book. No provisions are made for holding the pages of the book in an open position, other than the suggestion of a rubber band. This device does not provide the mobility, ease of maintaining the current page, or protection of the book that the present invention does.

U.S. Pat. No. 5,112,021, issued to Philip D. Greene on May 12, 1992 discloses a stationary, wall or floor mounted device for holding a book face down on a transparent plate above a reclined individual's head, with the pages being held in an open position by the weight of the book on the plate and the book held in place by a lip at the lower edge of the plate. This device provides no opportunity for mobility or use in any other configuration, as does the instant invention.

None of the above inventions and patents, taken either singly or in combination, is seen to describe the instant invention as claimed.

SUMMARY OF THE INVENTION

The present invention provides an easily used holder for a book which allows the reader great flexibility in positioning of his book and ease in turning pages, as well as security in maintaining the open book at the desired pages.

Accordingly, it is a principal object of the invention to hold a book in an open position without the aid of the reader's hands.

It is another object of the invention to ensure that the pages of the book can be turned easily and held open at the desired page without the aid of the reader's hands.

It is a further object of the invention to hold the book in a stationary position which will facilitate ease in reading without the use of the reader's hands, with the exception of turning pages.

Still another object of the invention is to store the device compactly when not in use.

An additional object of the invention is to provide protection to the book from the elements, such as water, sand or dirt by allowing the reader to grasp the holder as opposed to the book itself.

It is again an object of the invention to provide an optional stand for supporting a book holder at the correct reading angle from the desk surface.

Yet another object of the invention is to provide an easily removable optional stand.

Still another object of the invention is to provide an optional stand with gripping feet for firm hold on horizontal or slightly sloping surfaces.

Another object of the invention is to provide an optional stand with stops to limit the degree of swivel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIEMENTS

Figure 1:
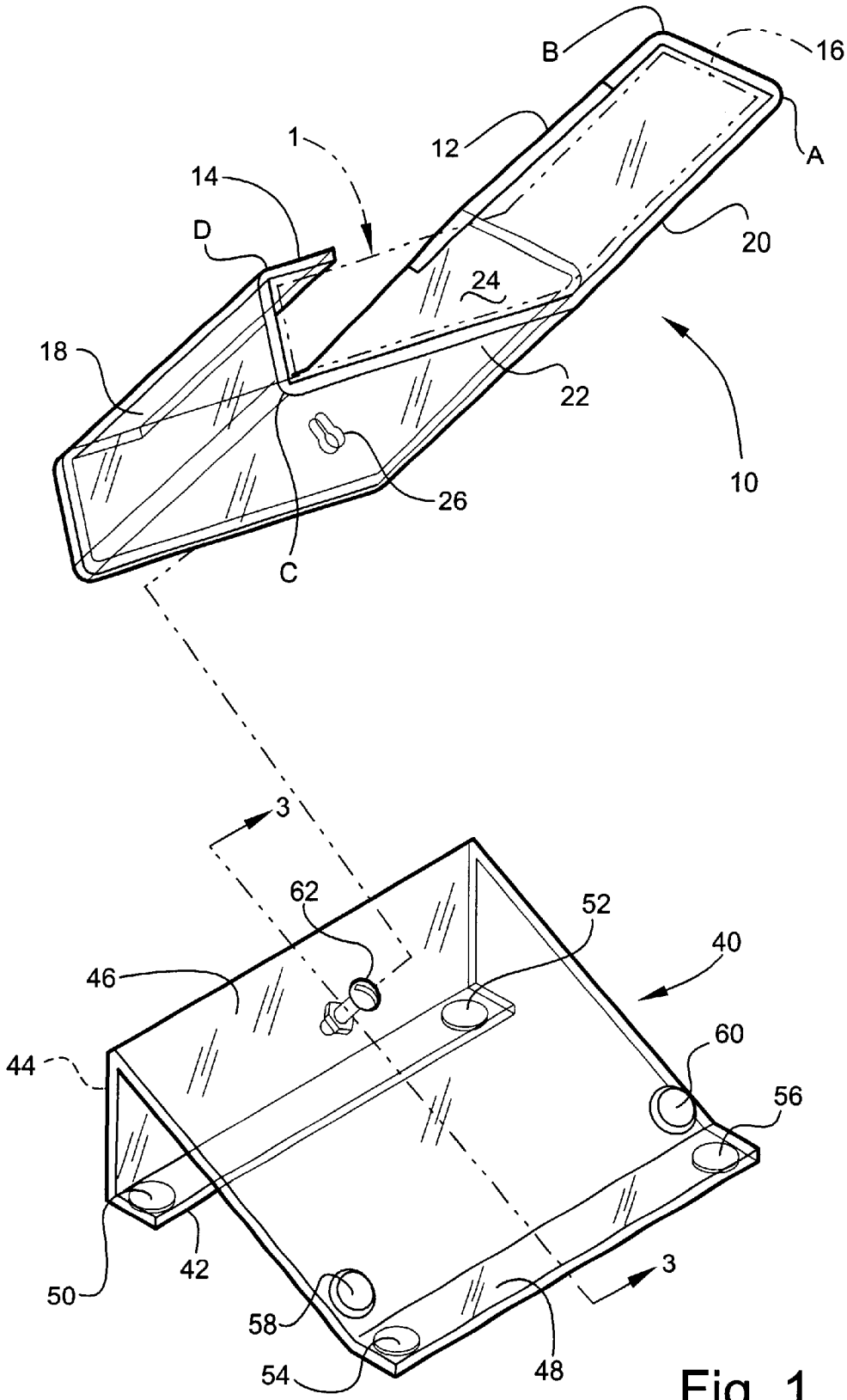
FIG. 1 is an exploded, environmental perspective of the book hold nd its optional swivel base.

The invention is intended for holding a book so that it may be read without concern for directly holding the book open to a specific page by hand. FIG. 1 shows the invention, book holder 10 containing a book 1 in an open position. Back pieces 20, 22, along with end pieces 16, 18, and bottom piece 24 form a cradle to hold book 1. Back pieces 20, 22 are set at an oblique angle to each other (approx. 145°), while end pieces 16, 18 extend from back pieces 20, 22 at an acute angle (approx 70°) such that book 1 can easily fit. Front tabs 12, 14 extend from end pieces 16, 18 at an obtuse angle (approx 112°) such that the sum of angles A and B is slightly greater than 180° and that angle A=angle C and angle B=angle D. Front tabs 12, 14 extend from end pieces 16, 18 to provide an overlap of the pages of book 1 sufficient to hold them in place without concern for the pages slipping. The obtuse angle between end pieces 16, 18 and front tabs 12, 14 facilitates slipping pages in and out from behind tabs 12, 14.

FIG. 1 further shows optional swivel base 40 with front base plate 42, front riser 44, angled riser 46 and rear base plate 48. Angled riser 46 is such that there is an angle of approximately 30° from the horizontal in order to facilitate an optimal angle of view while reading in a seated position at a desk or table. On each end of front base plate 42 and rear base plate 48 is a non-slip foot 50, 52, 54, 56. On each side of the top rear edge of angled riser 46 are limit stops 58, 60 which limit the degree of swivel of book holder 10 when it is attached to optional swivel base 40. Centered near the front center of angled riser 46 is interlock key 62 which engages with keyhole slot 26 of book holder 10 to provide both an interlock with book holder 10 and optional swivel base 40 and a pivot point between book holder 10 and optional swivel base 40 allowing book holder 10 to swivel on optional swivel base 40.

When the invention is not in use, optional swivel base 40 can be stored, on edge, nested inside book holder 10, with rear base plate 48 tucked into the opening created by the juncture of front tab 12, end piece 16 and back piece 20 or their counterparts 14, 18, 22 and front riser 40 along the junction of back pieces 20, 22.

Figure 2:
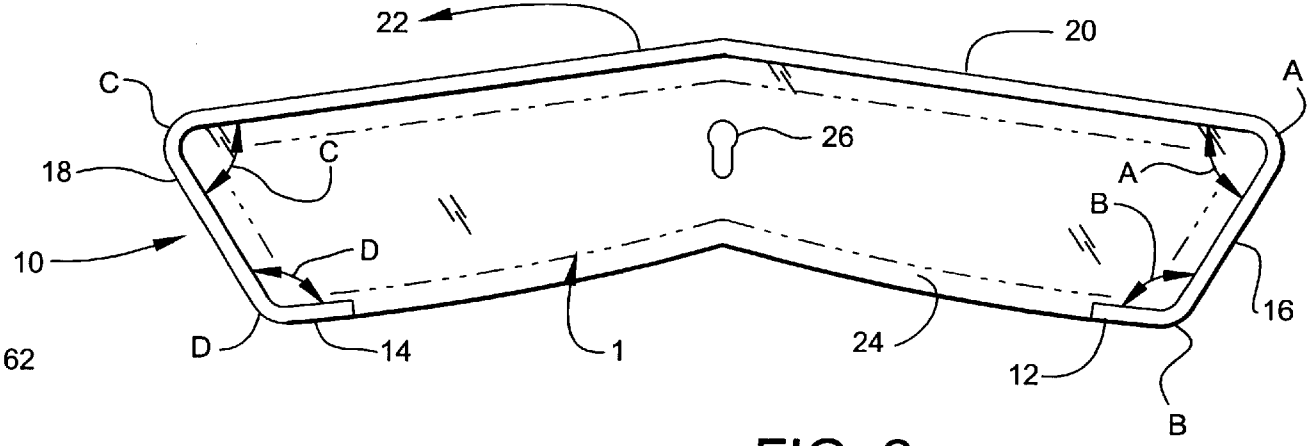
FIG. 2 is a top view of the book holder.

In FIG. 2 is shown book 1 with pages secured by front tabs 12, 14. Keyhole slot 26 is utilized for engaging interlock key 62 of the optional swivel base 40.

Figure 3:
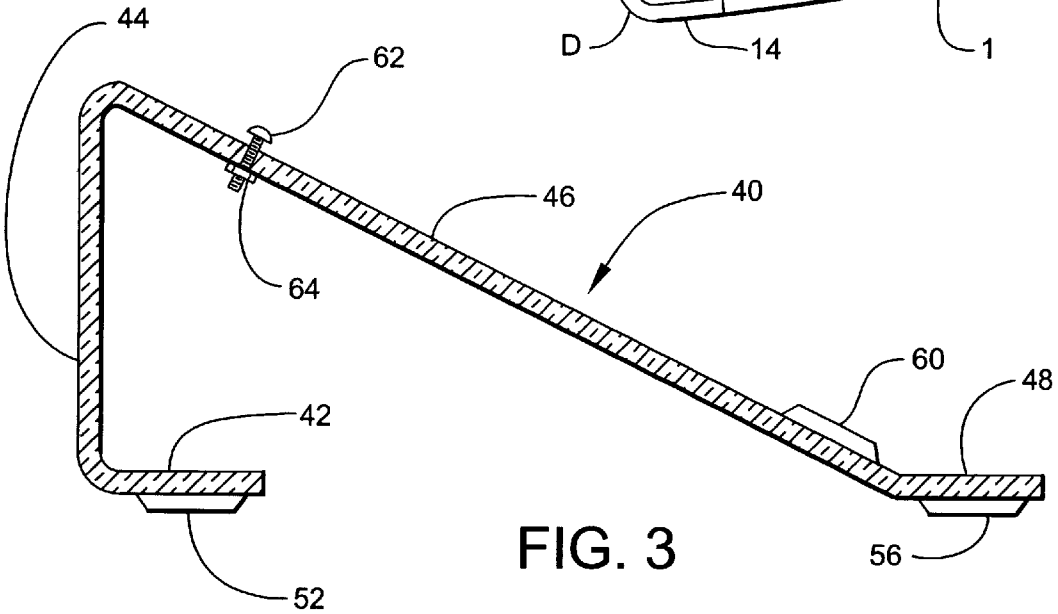
FIG. 3 is an end view cross section at line 3—3 of FIG. 1 of the optional swivel base of the invention.

FIG. 3 shows detail of the interlock key 62, which could be affixed to optional swivel base 40 in a number of different ways. In this drawing it is secured with a locking nut, but it could likewise be mounted by screwing it into the base material, or forming it as part of an injection molding process.

For purposes of clarity, the above drawings list individual parts as though the book holder and the separate optional swivel base were being assembled from individual component parts. It would be obvious to one skilled in the art that production of both book holder 10 and optional swivel base 40 could be by injection molding, vacuum forming, extrusion, or other means which would render the individual parts as a single piece and that stated angles formed by back pieces 20, 22, end pieces 16, 18, and front tabs 12, 14 could be altered. It would also be obvious to anyone skilled in the art that production of book holder 10 and optional swivel base 40 could be of a transparent, translucent or opaque material of virtually any type, but the preferred material for front tabs 14, 16 is a transparent material to facilitate being able to read text at the edge of pages tucked behind them. It would further be obvious to anyone skilled in the art the front tags 14, 16 would not necessarily need to be of a consistent width, but could rather be tapered in at either the ends or cut away in the middle portion of their length. It would also be obvious to anyone skilled in the art that the attachment of a pen/pencil holder or reading light to book holder 10 would be logical options for those readers who habitually take notes or highlight text as they read or read in a darkened environment. Again, it would be obvious to anyone skilled in the art that the method of mating said book holder and optional swivel base could be of a variety of arrangements, either allowing for a swivel or stationary mating. It would further be obvious to anyone skilled in the art that book holder 10 could be produced in a variety of sizes to accommodate books of differently sized and that differing sizes of book holder 10 could be marketed as individual items, as a nested set of several sizes, with optional swivel base 40 packaged with book holder 10 or with optional swivel base 40 being sold as a separate item.

It is to be understood that the present invention is not limited to the embodiments described above, but encompasses any and all embodiments within the scope of the following claims.

I claim:

1. A book holder comprising:

an angled back comprising two back pieces of sufficient width to provide for an open book cover to rest against it, an end piece abutting each side of the angled back at an acute angle, such end pieces extending forward by a distance sufficient to accommodate the thickness of said book, front tabs abutting said end pieces and returning toward the center of the holder's front face, at an obtuse angle, by a distance sufficient to retain the outer edges of the open pages of said book, with a solid bottom piece abutting the angled back, end pieces and front tabs, filling the entire void between them, supporting the lower edge of said book and wherein said bottom piece is located a keyhole slot located along the front to rear center line and set back slightly from the front edge of said bottom piece said keyhole slot adapted for connection to a swivel base.

2. A book holder as defined in claim 1 wherein the said front tabs are bent outward slightly from the plane parallel to the corresponding said back pieces in order to accommodate the sliding of page edges thereunder.

3. A book holder as defined in claim 1 in combination with an optional swivel base comprising a front base plate rearwardly projecting from the lower edge of a front riser, an angled riser sloping rearwardly from the top edge of the front riser to a rear base plate resting directly on a table top or other surface, with said angled riser having an upwardly protruding interlock key positioned along the front to rear center line of said angled riser and set back slightly from its front edge, said interlock key designed to interlock with the keyhole slot in the bottom piece of said book holder to provide both an interlock between the book holder and said optional swivel base and provide a pivot point for the swiveling book holder 10 on optional swivel stand 40.

4. A book holder as defined in claim 3, wherein said optional swivel base has limit stops positioned near each rear corner of the angled riser to limit the degree of swivel of said book holder mounted to said optional swivel base.

5. A swivel base as defined in claim 3 for supporting a book holder or other such item manufactured with a compatible mating slot.

* * * * *